US005163766A

United States Patent [19]

Fushimi et al.

[11] Patent Number: 5,163,766

[45] Date of Patent: Nov. 17, 1992

[54] PRINTER DEVICE

[75] Inventors: Kazuhiro Fushimi; Takeshi Tashiro; Tsugio Shiozaki, all of Shizuoka, Japan

[73] Assignee: Tokyo Electric Co., Ltd., Tokyo, Japan

[21] Appl. No.: 841,800

[22] Filed: Feb. 26, 1992

[30] Foreign Application Priority Data

Feb. 27, 1991 [JP] Japan ..... 3-55996

[51] Int. Cl.[5] ..... B41J 29/02

[52] U.S. Cl. ..... 400/692; 400/88; 400/691; 101/288

[58] Field of Search ..... 400/88, 193, 691, 692, 400/693; 101/288; 235/432, 472; 136/230; D13/184, 103

[56] References Cited

U.S. PATENT DOCUMENTS

D. 236,492 8/1975 Helgesson ..... D13/103
D. 237,973 12/1975 Stern ..... D13/103
4,634,304 1/1987 Narushima ..... 400/88
5,065,002 11/1991 Tashiro et al. ..... 235/472

*Primary Examiner*—Edgar S. Burr
*Assistant Examiner*—Joseph R. Keating
*Attorney, Agent, or Firm*—Oblon, Spivak, McClelland, Maier & Neustadt

[57] ABSTRACT

Disclosed is a printer device including a printer body and a battery section. The printer body is provided with a paper accommodating portion for replaceably accommodating printing paper. A driving circuit section is located on one side of the paper accommodating portion for controlling an operation of the printer body. The driving circuit section has at least an operating portion. The battery section has a substantially L-shaped configuration formed by a rectangular body located below the paper accommodating portion and a projecting portion located below the driving circuit section so as to project from one end of the rectangular body.

5 Claims, 8 Drawing Sheets

1
4
6
19
20
21
22
23
24
30
31
32
33
34
35

PRINTER DEVICE

FIELD OF THE INVENTION AND RELATED ART STATEMENT

The present invention relates to a printer device such as a portable label printer.

In a conventional printer device such as a portable label printer, it is known that a rechargeable battery is included as a power source and that a rechargeable battery or a dry battery is replaceable. It is also known that such a replaceable battery is employed as a battery cassette to improve operability. In such a printer device, the battery cassette is detachably mounted on a printer body of the printer device, and a paper accommodating portion for replaceably accommodating a roll of printing paper is formed in the printer body.

In this manner, since the printing paper is accommodated in the printer body and the battery cassette is included as a power source in the printer device, a printing operation can be carried out in various circumstances.

In such a printer device having a detachable battery cassette, it is general that the battery cassette having a rectangular form is laterally mounted on the bottom of the printer body to ensure a good weight balance. However, the battery cassette cannot be reduced in size because necessary power must be ensured. Accordingly, a length of the battery cassette restricts a reduction in width of the printer body to hinder a reduction in size and weight of the printer device.

Further, as mentioned above, the conventional battery cassette is formed in a rectangular configuration. Accordingly, in the case where an operator is inexperienced or an operation environment is dark, there is a possibility that the operator cannot recognize a mounting direction of the battery cassette.

And further, it is known that a handy terminal provided with an information output projection for optically outputting data is used to input the data into the printer body. In using the handy terminal in connection with the printer device, the information output projection of the handy terminal is inserted into an information input hole formed on the printer body. However, as the printer device is portable, the printer body is apt to be moved in using the handy terminal in connection with the printer device, thus largely reducing operability.

OBJECT AND SUMMARY OF THE INVENTION

It is a first object of the present invention to reduce the size of a printer body.

It is a second object of the present invention to prevent an error of the mounting direction of a battery cassette.

It is a third object of the present invention to stabilize the printer body and thereby improve the operability in case of inputting data from a handy terminal.

According to the present invention, there is provided in a printer device including a printer body and a battery section, the printer body being provided with a paper accommodating portion for replaceably accommodating printer paper; the improvement comprising a driving circuit section located on one side of the paper accommodating portion for controlling an operation of the printer body, the driving circuit section having at least an operating portion, wherein the battery section has a substantially L-shaped configuration formed by a rectangular body located below the paper accommodating portion and a projecting portion located below the driving circuit section so as to project from one end of the rectangular body.

As described above, the battery section is formed in a substantially L-shaped configuration in such a manner that the rectangular body of the battery section is located below the paper accommodating portion and the projecting portion of the battery section is located below the driving circuit section so as to project from one end of the rectangular body. Accordingly, a lateral length of the battery section can be reduced without reducing a battery capacity, thereby contributing to a reduction in lateral size of the printer body. Furthermore, the projecting portion projecting from one end of the rectangular body located below the paper accommodating portion which is hard to change in shape and reduce in size is located below the driving circuit section which is easy to change in shape. Accordingly, no dead space is defined in the printer device, thereby reducing the size of the printer device.

Moreover, the information input hole to be engaged with the information output projection of the handy terminal for optically outputting data is formed on a front surface of the printer body at a position in the vicinity of an upper end portion of the printer body. Accordingly, even when the printer body is held by a shoulder belt, the printer body can be stabilized in inputting the data from the handy terminal, thus improving the operability.

DETAILED DESCRIPTION OF THE PREFERRED EMBODIMENT

Figure 2:
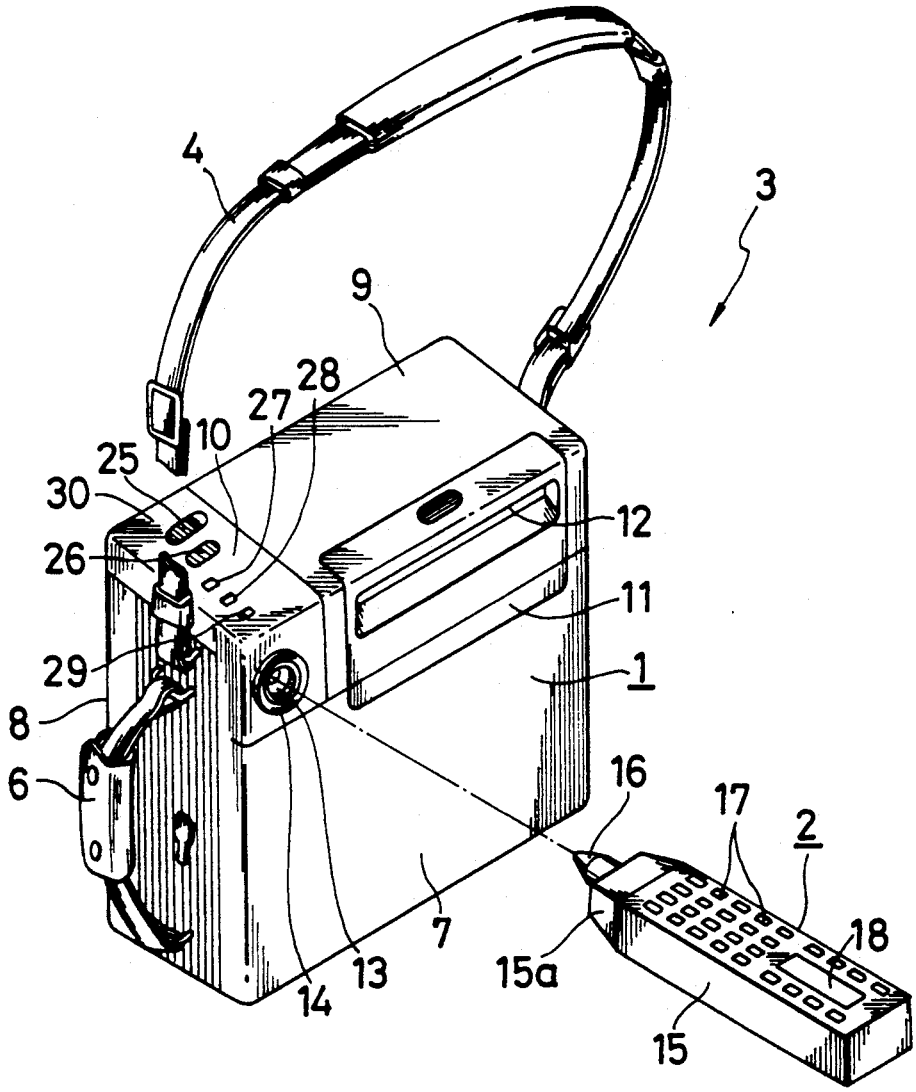
FIG. 2 is a perspective view of an optical data transfer system constituted of the printer device and a handy terminal as viewed from the front side.

A preferred embodiment according to the present invention will now be described with reference to the drawings. A portable label printer 1 as a printer device according to the present invention is adapted to be combined with a handy terminal 2 also serving as a bar code scanner to constitute an optical data transfer system 3 as shown in FIG. 2.

A shoulder belt 4 adjustable in length is provided on opposite side surfaces of the label printer 1 at the upper portion thereof, and a belt handle 6 is provided on one of the opposite side surfaces of the label printer 1. A housing of the label printer 1 is constituted of a front cover 7, a rear cover 8 connected to the front cover 7 on the rear side thereof, a printer cover 9 and an interface cover 10 juxtaposed to the printer cover 9 on the upper side of the front cover 7 and the rear cover 8. A base sheet eject opening 11 is formed between an upper edge of the front cover 7 and a lower edge of the printer cover 9 so as to extend laterally of the label printer 1, and a label issue opening 12 is formed on a front surface of the printer cover 9 so as to extend laterally of the label printer 1. In the optical data transfer system 3, an information input hole 13 is formed on a front surface of the interface cover 10, and an annular support ring 14 is mounted on an outer circumference of the information input hole 13.

A housing 15 of the handy terminal 2 is formed at its one end with a tapering portion 15*a*. An information output projection 16 is provided on a front surface of the tapering portion 15*a*. A keyboard 17 and a display 18 are arranged on an upper surface of the housing 15. The information output projection 16 of the handy terminal 2 has a stepped tapering shape such that a circular cone is connected with a cylinder, and an optical lens is mounted at a front end of the information output projection 16.

Figures 1A, 1B, 1C:
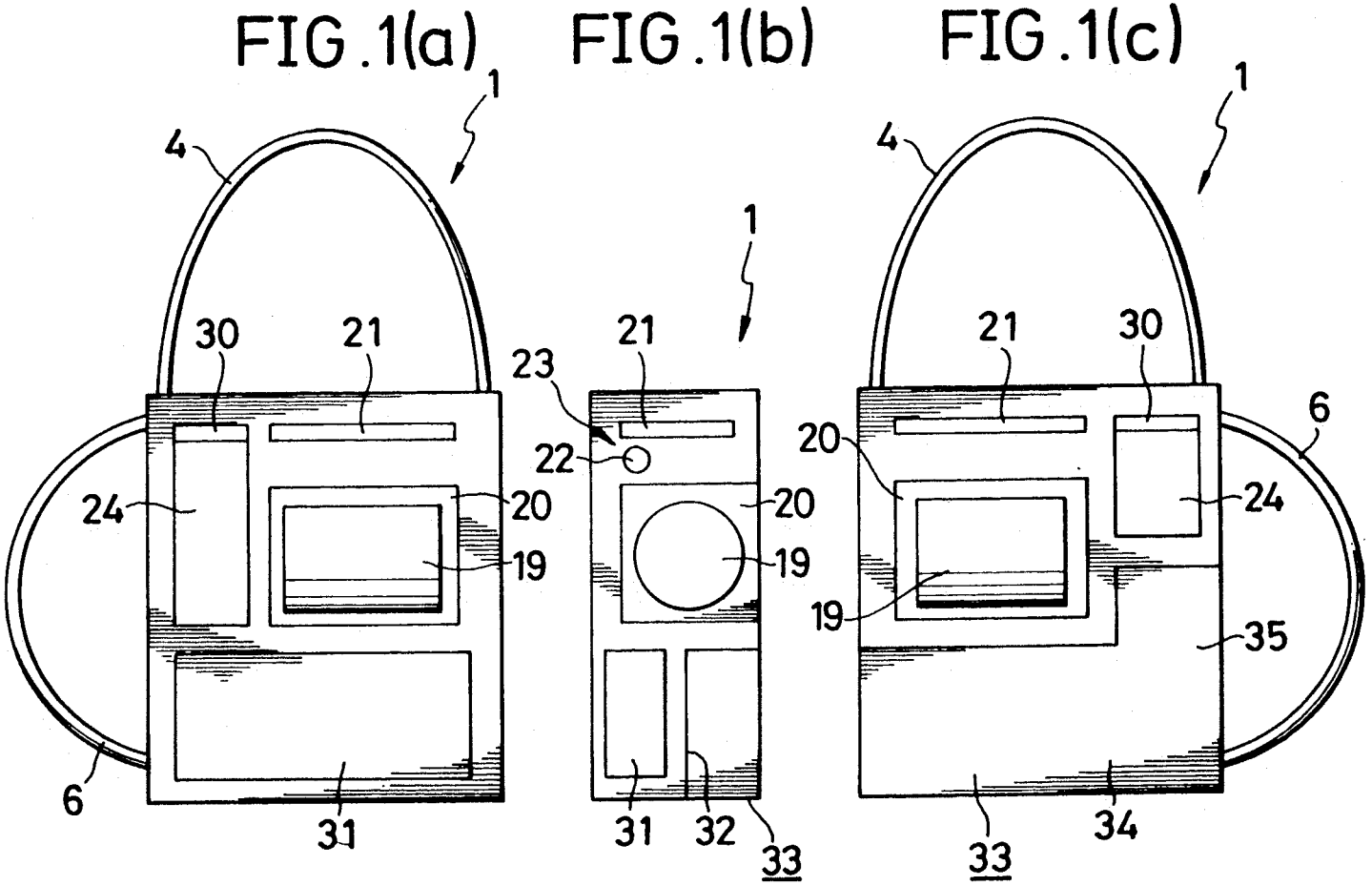
FIG. 1A is a front elevation schematically illustrating the arrangement of internal parts of a printer device in a preferred embodiment according to the present invention.
FIG. 1B is a side elevation of FIG. 1A.
FIG. 1C is a rear elevation of FIG. 1A.
Figure 3A:
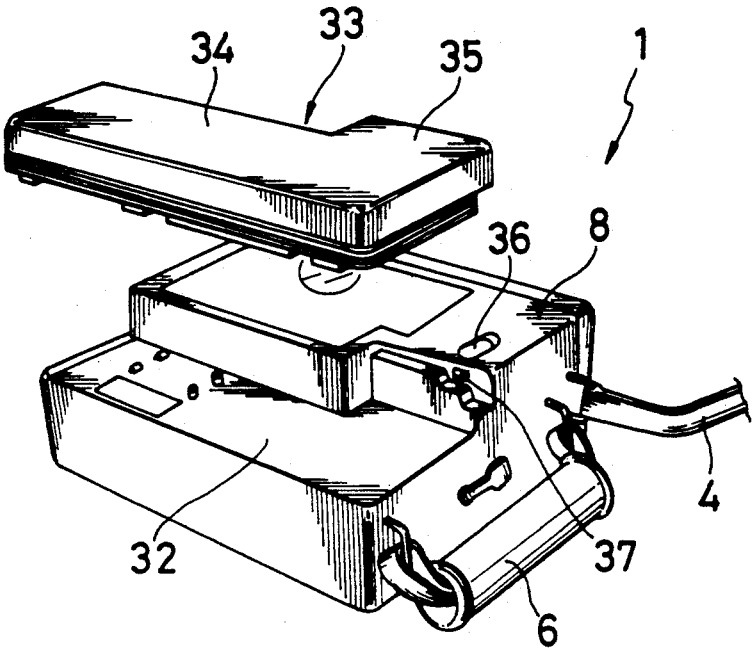
FIG. 3A is a perspective view illustrating a demounted condition of a battery cassette.
Figure 3B:
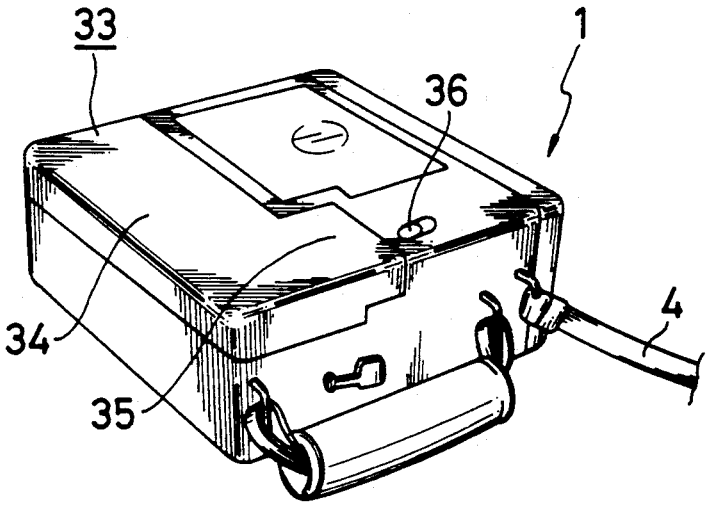
FIG. 3B is a perspective view illustrating a mounted condition of the battery cassette.

The arrangement of internal parts of the label printer 1 is shown in FIGS. 1A, 1B and 1C. FIG. 1A is a front view of the arrangement; FIG. 1B is a side view of the arrangement; and FIG. 1C is a rear view of the arrangement. As shown in FIGS. 1A to 1C, a paper accommodating portion 20 for replaceably accommodating a roll of printing paper 19 is formed in the housing of the label printer 1 at the upper portion thereof on the side of the rear cover 8. A printing mechanism 23 including a line head 21 and a platen roller 22 is located inside the printer cover 9 above the paper accommodating portion 20. A driving circuit portion 24 including a driving motor (not shown) for driving the printing mechanism 23 is located on a lateral side of the paper accommodating portion 20 and the printing mechanism 23. An operating portion 30 including various switches 25 and 26 and LEDs (Light Emitting Diodes) 27, 28 and 29 is provided on the interface cover 10 above the driving circuit portion 24. A driving circuit portion 31 for controlling the operation of the printing mechanism 23 in cooperation with the driving circuit portion 24 is located below the paper accommodating portion 20 on the side of the front cover 7. As shown in FIGS. 1C, 3A and 3B, an L-shaped battery mounting surface 32 is formed below the paper accommodating portion 20 on the side of the rear cover 8.

A battery cassette 33 is detachably mounted on the battery mounting surface 32. The battery cassette 33 has an L-shape such that a rectangular cassette body 34 is located below the paper accommodating portion 20 and a projecting portion 35 is located below the driving circuit portion 24 so as to project toward the same from one end of the cassette body 34. A manual lock button 36 is located on the rear cover 8 at a position above the projecting portion 35, and a slidable lock lever 37 is connected to the manual lock button 36 so as to be normally biased by a spring (not shown) toward the projecting portion 35. That is, a lock hole (not shown) adapted to be disengageably engaged with the lock lever 37 is formed on an upper surface of the projecting portion 35 of the battery cassette 33.

Figure 4:
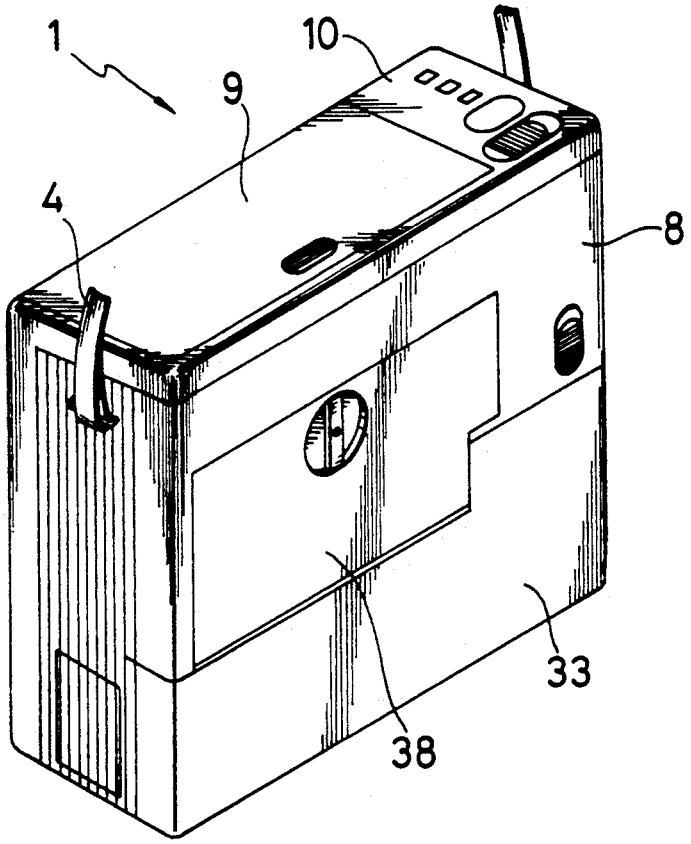
FIG. 4 is a perspective view of the printer device as viewed from the rear side.

As shown in FIG. 4, the rear cover 8 of the label printer 1 is formed at its substantially central portion with an insert opening 38 for inserting a label sheet (not shown) as a printing medium, and the battery cassette 33 of a rechargeable type is detachably located below the insert opening 38. In hanging the label printer 1 with the shoulder belt 4, it is intended in the preferred embodiment that the rear cover 8 contacts an operator's body.

Figure 5A:
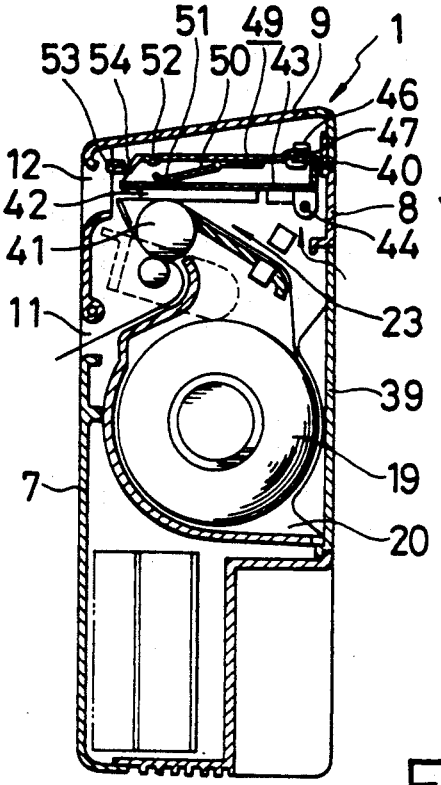
FIG. 5A is a vertical sectional view of the printer device under the condition where a printer cover is closed.
Figure 5B:
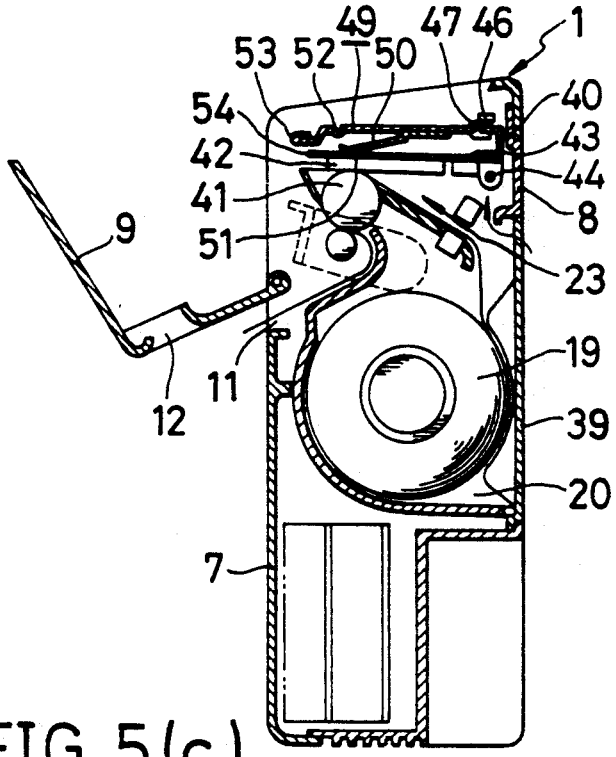
FIG. 5B is a view similar to FIG. 5A, under the condition where the printer cover is opened.
Figure 5C:
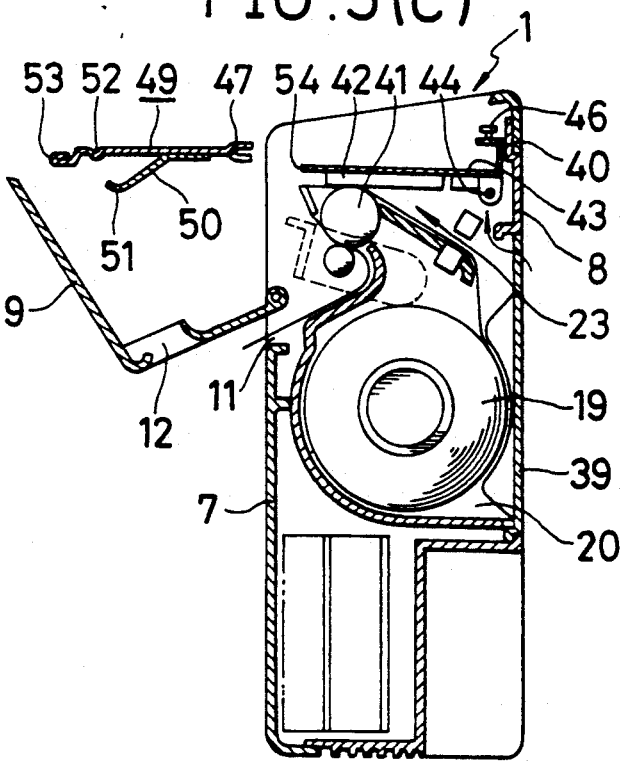
FIG. 5C is a view similar to FIG. 5B, under the condition where a pressure plate is removed.
Figure 6:
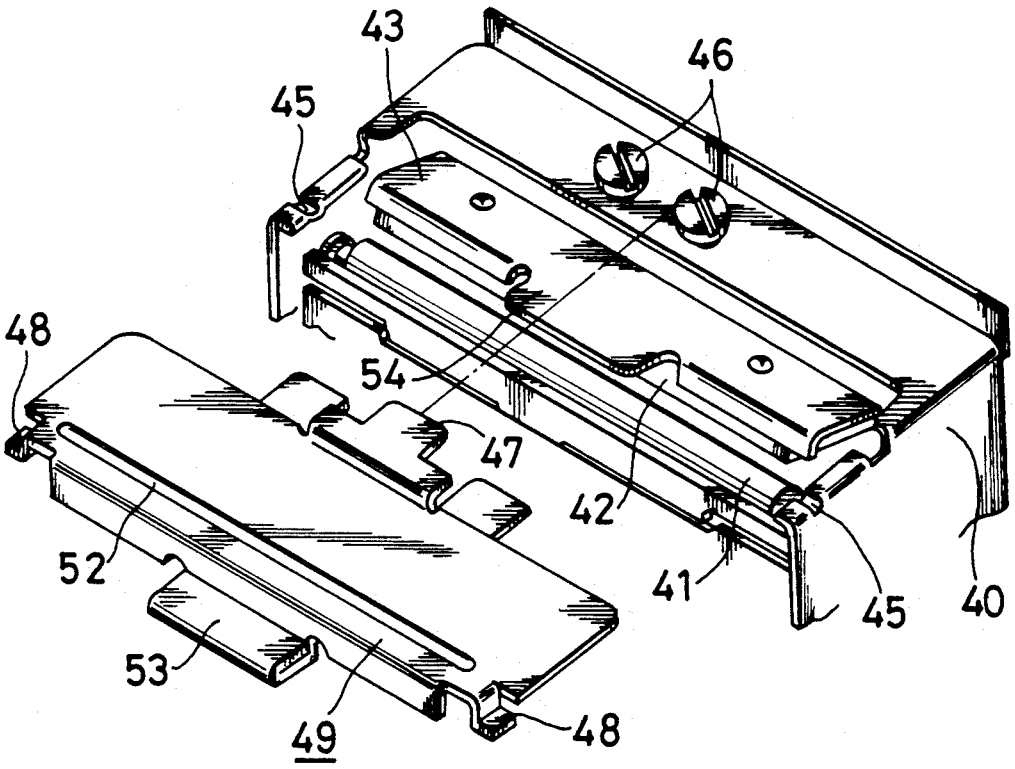
FIG. 6 is an exploded perspective view of an essential part shown in FIGS. 5A to 5C.

As shown in FIGS. 5A to 5C, the paper accommodating portion 20 for replaceably accommodating the printing paper 19 is formed in the housing of the label printer 1. A cover member 39 for openably closing the paper accommodating portion 20 is mounted on the rear cover 8. Similarly, the printer cover 9 is provided to openably covering the printing mechanism 23 of the label printer 1. The printing mechanism 23 includes a U-shaped main frame 40 shown in FIG. 6. A platen roller 41 is rotatably supported to opposite side walls of the main frame 40, and a line head 42 of a thermal type is provided in opposed relationship to the platen roller 41 so as to come into contact with or separation from the platen roller 41. The line head 42 is mounted on a support plate 43 as a supporting mechanism. The support plate 43 is rotatably supported through a rotating shaft 44 to the opposite side walls of the main frame 40, thus allowing the line head 42 to come into contact with or separation from the platen roller 41. The opposite side walls of the main frame 40 are bent inwardly at their upper ends, and such inward bent portions of the side walls are formed with two downward projections 45 formed by pressing or the like. Two guide pins 46 are mounted on an upper surface of the main frame 40. A pressure plate 49 is detachably mounted on the main frame 40. The pressure plate 49 is formed at its rear end with a projection 47 adapted to be inserted between the two guide pins 46 of the main frame 40 and engaged with the two guide pins 46. The pressure plate 49 is formed at its opposite side edges with two stepped portions 48 adapted to be engaged with the two downward projections 45 of the main frame 40, respectively. As shown in FIGS. 5A to 5C, two leaf springs 50 for pressing the line head 42 against the platen roller 41 are mounted on a lower surface of the pressure plate 49. Each leaf spring 50 is bent upwardly at its front end 51. The upward bent portion 51 is adapted to contact a reinforcing bead 52 projecting downwardly from the lower surface of the pressure plate 49, thus constituting a plastic deformation preventing mechanism to be hereinafter described. Furthermore, the pressure plate 49 is formed at its front end with a knob 53, and the support plate 43 is formed at its front end with a knob 54 adapted to face the knob 53 of the pressure plate 49.

Figure 7:
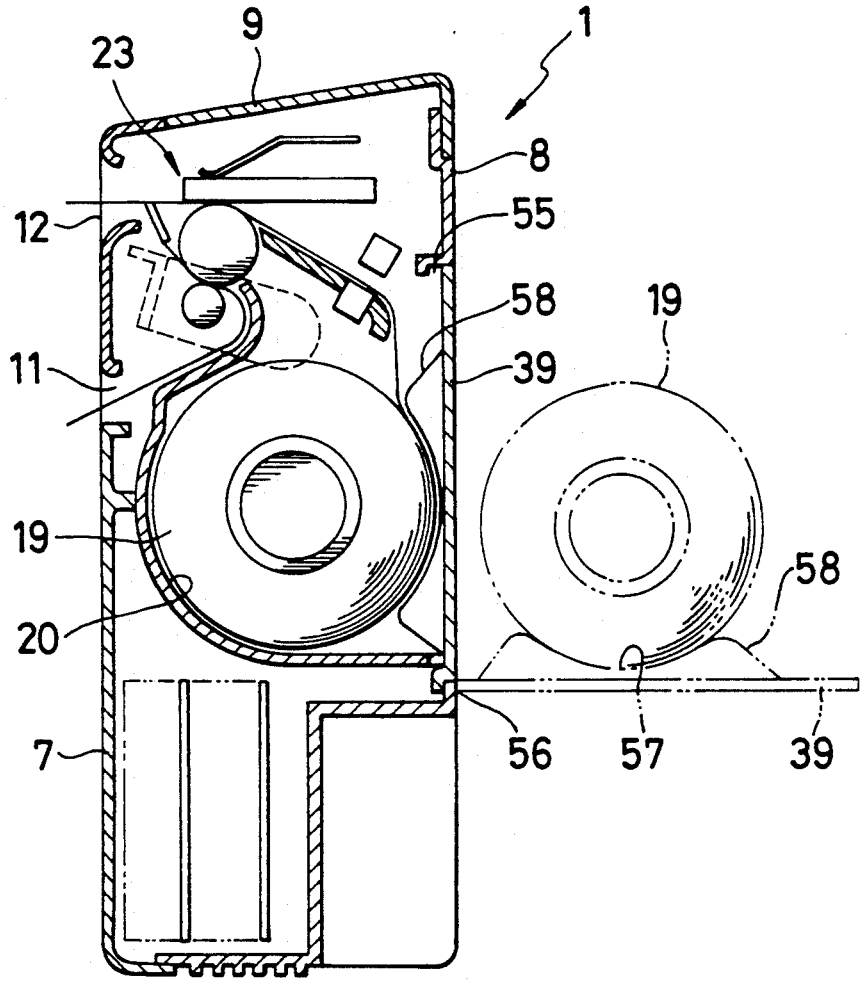
FIG. 7 is a vertical sectional view of the printer device under the condition where a cover member is opened.
Figure 8:
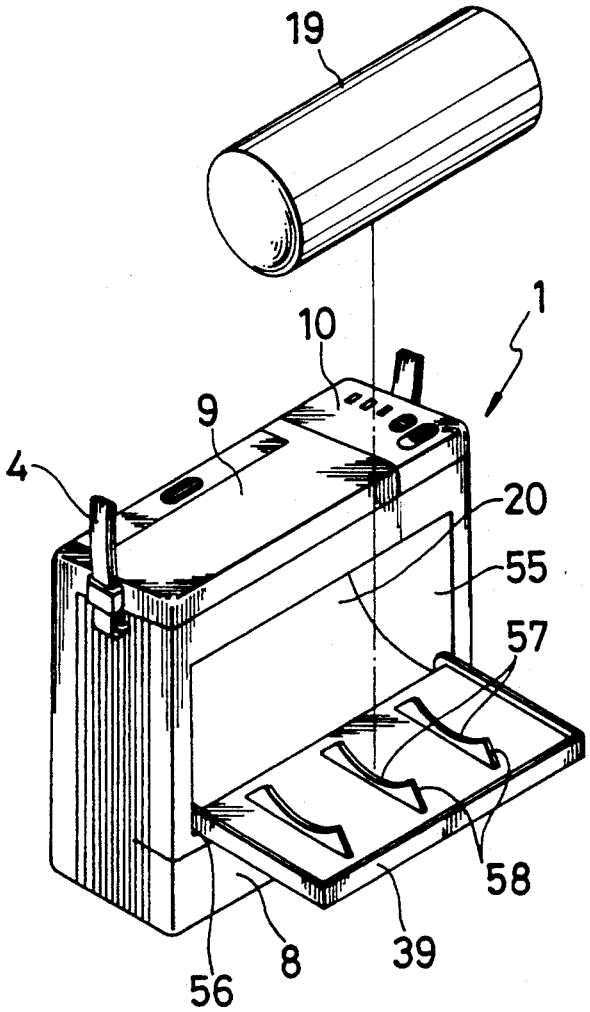
FIG. 8 is a perspective view of FIG. 7.

As shown in FIGS. 7 and 8, the paper accommodating portion 20 for replaceably accommodating the printing paper 19 is formed in the housing of the label printer 1. The rear cover 8 is formed with a paper insert opening 55 communicating with the paper accommodating portion 20. The paper insert opening 55 is openably closed by the cover member 39. The cover member 39 is rotatably supported at its lower end to the rear cover 8 in such a manner that the cover member 39 can be opened from its closed or vertical position to a substantially horizontal position shown by a phantom line in FIG. 7. The horizontal or open position of the cover plate 39 is maintained by a stopper mechanism 56 formed by contact of the lower end of the cover plate 39 with a lower edge of the paper insert opening 55. As shown in FIG. 8, a plurality of reinforcing ribs 58 are formed on an inside surface of the cover member 39 so as to be arranged side by side at given intervals. An upper edge of each reinforcing rib 58 is formed at its central portion with an arcuate recess 57 for placing the printing paper 19 under the horizontal condition of the cover plate 39.

In the optical data transfer system 3, when a commodity data or the like is input into the handy terminal 2 by operating the keyboard 17 or reading a bar code, for example, the data is temporarily stored into an internal memory such as a RAM (Random Access Memory) provided in the handy terminal 2. Then, the information output projection 16 of the handy terminal 2 storing the data is inserted into the information input hole 13 of the label printer 1, and the keyboard 17 is then operated. As a result, the data is output as an optical signal from the information output projection 16 of the handy terminal 2 to the label printer 1. Then, the optical signal input into the label printer 1 is converted into an electrical signal by a photodetector (not shown) provided in the label printer 1, and the electrical signal is temporarily stored into an internal memory such as a RAM provided in the label printer 1. The data stored in the internal memory of the label printer 1 is utilized for issuance of bar code labels or management of commodity information, for example.

In mounting the battery cassette 33 onto the battery mounting surface 32 as shown in FIGS. 3A and 3B, the battery cassette 33 is slid under pressure on the battery mounting surface 32 to bring engaging portions (not shown) of the battery cassette 33 and the battery mounting surface 32 into engagement with each other and simultaneously bring the lock lever 37 into engagement with the lock hole of the battery cassette 33. The battery mounting surface 32 and the battery cassette 33 are formed in the L-shape to make a mounting direction of the battery cassette 33 be clearly recognized. Accordingly, even when the operator is inexperienced or the operation environment is dark, the operator can easily mount the battery cassette 33 onto the battery mounting surface 32.

Since the battery cassette 33 is formed in the L-shape, a lateral length of the battery cassette 33 can be reduced without reducing a battery capacity, thereby contributing to a reduction in lateral size of the label printer 1. And further, since the projecting portion 35 of the battery cassette 33 is located below the driving circuit portion 24 so as to project along one side of the paper accommodating portion 20, enlargement in vertical size of the label printer 1 can be prevented. In other words, since the paper accommodating portion 20 accommodates the printing paper 19 of a given volume, the paper accommodating portion 20 is difficult to change in shape or reduce in size. However, the driving circuit portions 24 and 31 can be formed in various shapes. Accordingly, by locating the cassette body 34 of the battery cassette 33 below the paper accommodating portion 20 and locating the projecting portion 35 of the battery cassette 33 and the driving circuit portion 24 sidelong the paper accommodating portion 20, a dead space can be eliminated to thereby generally reduce the size of the label printer 1.

In mounting and demounting the battery cassette 33 under the condition where the label printer 1 is not placed on a table or the like, it is intended that the label printer 1 is turned sideways by gripping the belt handle 6. In this condition, the projecting portion 35 of the battery cassette 33 is located on the upper side, so that there is no possibility that the battery cassette 33 falls from the battery mounting surface 32. Furthermore, under the condition where the label printer 1 is hung with the shoulder belt 4, the rear cover 8 of the label printer 1 is intended to contact an operator's body. As shown in FIG. 1, the switches 25 and 26 of the operating portion 30 are arranged on the side of the rear cover 8, and the LEDs 27 to 29 are arranged on the side of the front cover 7. Accordingly, there is no possibility that the LEDs 27 to 29 are shielded by an operator's finger operating the switches 25 and 26, thus improving both operability and visibility.

In the optical data transfer system 3, even when the label printer 1 is not placed on a table or the like, data transfer can be effected by inserting the information output projection 16 of the handy terminal 2 into the information input hole 13 of the label printer 1. In this case, the label printer 1 is held by hanging the shoulder belt 4 on an operator's shoulder or neck, for example, and in this condition, the information output projection 16 of the handy terminal 2 is inserted into the information input hole 13 of the label printer 1. In such a suspended condition of the label printer 1, the upper central portions of the opposite side surfaces of the label printer 1 are suspended by the shoulder belt 4, and the battery cassette 33 having a relatively large weight is located at the lower portion of the label printer 1 on the side of the rear cover 8. Accordingly, the lower portion of the rear cover 8 separates from the operator's body, while the upper portion of the rear cover 8 contacts the operator's body. Thus, the upper portion of the label printer 1 where the information input hole 13 is formed is initially maintained in contact with the operator's body. Accordingly, in inserting the information output projection 16 of the handy terminal 2 into the information input hole 13 of the label printer 1, possible displacement of the information input hole 13 is prevented to thereby make the operation very easy.

Moreover, the information input hole 13 of the label printer 1 is located at substantially the same level as that of the mounted portions of the shoulder belt 4. Accordingly, in inserting the information output projection 16 of the handy terminal 2 into the information input hole 13, possible rotation of the label printer 1 is prevented to thereby make the insert operation very easy.

In this manner, according to the optical data transfer system 3, data transfer from the handy terminal 2 to the label printer 1 is realized optically without the necessity of use of a connecting cable. And further, as the shoulder belt 4 and the information input hole 13 are located at the upper portion of the label printer 1, and the heavy battery cassette 33 is located at the lower portion of the label printer 1 on the rear side, the label printer 1 and the handy terminal 2 can be maintained in a desired position in performing the data transfer, thereby preventing an error of data transfer.

In the label printer 1, the line head 42 is normally pressed against the circumferential surface of the platen roller 41 by an elastic force of the leaf springs 50 of the pressure plate 49, thereby ensuring good image formation. As shown in FIGS. 5A to 5C, when the printer cover 9 is opened and the pressure plate 49 is then removed from the main frame 40, the line head 42 is allowed to be largely moved away from the platen roller 41. Accordingly, a maintenance operation such as a jam treatment can be easily carried out. Furthermore, when the printer cover 9 is opened and the knobs 53 and 54 of the pressure plate 49 and the support plate 43 are pinched with fingers or the like, the line head 42 is forcibly separated from the platen roller 41 against the elastic force of the leaf springs 50. Accordingly, a paper setting operation wherein a sheet of the printing paper 19 is to be inserted between the line head 42 and the platen roller 41 can be easily carried out. In forcibly separating the line head 42 from the platen roller 41 against the elastic force of the leaf springs 50, an amount of elastic deformation of the leaf springs 50 can be limited to a value less than an elastic limit because the front end 51 of each leaf spring 50 is adapted to abut against the reinforcing bead 52 of the pressure plate 49. Thus, plastic deformation of the leaf springs 50 can be reliably prevented.

In this manner, by pinching the knobs 53 and 54 of the pressure plate 49 and the support plate 43, the line head 42 can be easily separated from the platen roller 41, so that the operator can easily set the sheet of the printing paper 19 in the printing mechanism 23. Furthermore, since the amount of elastic deformation of the leaf springs 50 is limited to the value less than the elastic limit, durability of the leaf springs 50 can be improved. Additionally, even when the pressure plate 49 removed from the main frame 40 is erroneously trampled down, possible plastic deformation of the leaf springs 50 is prevented because the amount of elastic deformation is limited to the value less than the elastic limit.

While the plastic deformation preventing mechanism for limiting the elastic deformation of the leaf springs 50 is formed by making the upward bent front end 51 of each leaf spring 50 abuttable against the downward projected reinforcing bead 52 of the pressure plate 49 in the above preferred embodiment, it is not limited to the above mechanism according to the present invention. For example, a pressure plate (not shown) having no reinforcing bead may be combined with a leaf spring (not shown) having a long upward bent front end, thus forming a plastic deformation preventing mechanism. Alternatively, a flat leaf spring (not shown) having no upward bent front end may be combined with a pressure plate (not shown) having a large downward projected reinforcing bead, thus forming a plastic deformation preventing mechanism.

Furthermore, the roll of the printing paper 19 may be of either an outside label type such that the labels are provided on the outside surface of the base sheet of the roll or an inside label type such that the labels are provided on the inside surface of the base sheet of the roll.

In replacing the printing paper 19 without placing the label printer 1 on a table or the like, the label printer 1 may be held by the shoulder belt 4 suspended from the operator's shoulder or neck, and in such a suspended condition, the cover plate 39 is opened. As shown in FIGS. 7 and 8, the cover member 39 is stopped in the substantially horizontal position, and the printing paper 19 can therefore be placed on the arcuate recesses 57 of the reinforcing ribs 58 formed on the inside surface of the cover member 39. Thereafter, an outer end of the printing paper 19 is inserted into the paper insert opening 55 to carry out a paper setting operation. After ending the paper setting operation, the printing paper 19 on the arcuate recesses 57 is brought into the paper accommodating portion 20, and the cover member 39 is then closed to complete the replacement of the printing paper 19.

In this way, the replacement of the printing paper 19 can be easily carried out even when no table or the like for placing the label printer 1 is present. In addition, the paper setting operation can be easily carried out since it is unnecessary to hold the roll of the printing paper 19 with an operator's hand. Moreover, since the arcuate recesses 57 for holding the printing paper 19 are formed on the reinforcing ribs 58 of the cover member 39, the structure is simplified and the productivity is improved.

In the case of placing the label printer 1 on a table or the like, the roll of the printing paper 19 can be prevented from rolling on the table in the paper setting operation since the roll of the printing paper 19 is held in position on the arcuate recesses 57 of the reinforcing ribs 58 of the cover member 39. Moreover, in this case, after setting the outer end of the printing paper 19 placed on the table into the label printer 1, it is necessary to manually rewind the printing paper 19 and bring the same into the paper accommodating portion 20 because the paper accommodating portion 20 is located apart from the table surface. However, according to the preferred embodiment, such a troublesome operation can be eliminated by placing the printing paper 19 on the arcuate recesses 57 of the reinforcing ribs 58 of the cover member 39.

What is claimed is:

1. In a printer device including a printer body and a battery section, said printer body being provided with a paper accommodating portion for replaceably accommodating printing paper; the improvement comprising a driving circuit section located on one side of said paper accommodating portion for controlling an operation of said printer body, said driving circuit section having at least an operating portion, wherein said battery section has a substantially L-shaped configuration formed by a rectangular body located below said paper accommodating portion and a projecting portion located below said driving circuit section so as to project from one end of the rectangular body.

2. The printer device as defined in claim 1 further comprising a printing section located in an upper portion of said printer body for printing the printing paper.

3. The printer device as defined in claim 1, wherein the printing paper is formed as a roll of a sheet of paper.

4. The printer device as defined in claim 1, wherein said battery section is a battery cassette detachably mounted on said printer body.

5. The printer device as defined in claim 1 further comprising a shoulder belt mounted to an upper end portion of said printer body and an information input hole formed on a front surface of said printer body at a position in the vicinity of the upper end portion of said printer body, said information input hole being adapted to engage an information output projection of a handy terminal for optically outputting data.

* * * * *